US012618560B2

(12) United States Patent
Mito

(10) Patent No.: US 12,618,560 B2
(45) Date of Patent: May 5, 2026

(54) DETECTION APPARATUS AND COMBUSTION SYSTEM

(71) Applicant: Yokogawa Electric Corporation, Musashino (JP)

(72) Inventor: Shinya Mito, Musashino (JP)

(73) Assignee: Yokogawa Electric Corporation, Tokyo (JP)

( * ) Notice: Subject to any disclaimer, the term of this patent is extended or adjusted under 35 U.S.C. 154(b) by 0 days.

(21) Appl. No.: 18/764,553

(22) Filed: Jul. 5, 2024

(65) Prior Publication Data

US 2025/0012442 A1 Jan. 9, 2025

(30) Foreign Application Priority Data

Jul. 7, 2023 (JP) ..... 2023-112557

(51) Int. Cl.
*F23N 5/24* (2006.01)
*F23N 5/08* (2006.01)

(52) U.S. Cl.
CPC ..... *F23N 5/082* (2013.01); *F23N 2231/28* (2020.01)

(58) Field of Classification Search
CPC ..... F23N 5/08; F23N 5/082; F23N 5/085; F23M 11/04; F23M 11/042; F23M 11/045; F23M 11/047; F02C 9/28; G01M 15/108; G01M 15/14
USPC ..... 374/131, 161, 144
See application file for complete search history.

(56) References Cited

U.S. PATENT DOCUMENTS

| | | | | |
|---|---|---|---|---|
| 5,961,314 | A | 10/1999 | Myhre et al. | |
| 6,530,207 | B2 * | 3/2003 | Tobo | F02C 9/28 60/39.091 |
| 9,353,947 | B2 * | 5/2016 | Krull | F23N 5/02 |
| 2010/0318274 | A1 | 12/2010 | Krull | |
| 2013/0008180 | A1 | 1/2013 | Diatzikis et al. | |

FOREIGN PATENT DOCUMENTS

| | | | |
|---|---|---|---|
| DE | 19825047 | A1 | 12/1998 |
| JP | H08145810 | A | 6/1996 |
| JP | 2002-507271 | A | 3/2002 |
| JP | 2010-286232 | A | 12/2010 |

(Continued)

OTHER PUBLICATIONS

Extended European Search Report dated Nov. 26, 2024, issued in counterpart Application No. 24186358.8. (9 pages).

(Continued)

*Primary Examiner* — Gerald L Sung
*Assistant Examiner* — Sean V Meiller
(74) *Attorney, Agent, or Firm* — WHDA, LLP

(57) ABSTRACT

A detection apparatus (10) for detecting a backfire in a combustion chamber (31) that burns fuel supplied from a plurality of supply ports includes a light source (12) that outputs incident light to an optical fiber (11) laid around the plurality of supply ports, a converter (13) that receives returned light from the optical fiber (11) and converts the received returned light into an electric signal, a calculator (14) that analyzes the returned light converted into an electric signal and calculates a temperature at a predetermined position of the optical fiber (11), and a detector (15) configured to detect a backfire in the combustion chamber (31) based on the calculated temperature.

10 Claims, 4 Drawing Sheets

(56) References Cited

FOREIGN PATENT DOCUMENTS

| | | | |
|---|---|---|---|
| JP | 2022-154838 | A | 10/2022 |
| KR | 10-2017-0034716 | A | 3/2017 |

OTHER PUBLICATIONS

Office Action dated Jan. 20, 2026, issued in counterpart JP Applicatino No. 2023-112557, with English translation. (9 pages).

* cited by examiner

DETECTION APPARATUS AND COMBUSTION SYSTEM

CROSS-REFERENCE TO RELATED APPLICATION

The present application claims priority to Japanese Patent Application No. 2023-112557 filed on Jul. 7, 2023, the entire contents of which are incorporated herein by reference.

TECHNICAL FIELD

The present disclosure relates to a detection apparatus and a combustion system.

BACKGROUND

In gas turbines equipped with a combustion apparatus that uses lean premix combustion, a detection apparatus for detecting backfire that occurs in the combustion apparatus is known. Backfire is a phenomenon in which the speed at which the flame progresses is higher than the speed of the fluid, such as fuel and air, resulting in the flame moving back up through the fluid. Although backfire can occur in principle in a gas turbine fueled by natural gas, backfire can be suppressed easily by limiting the operating conditions.

In recent years, the demand for hydrogen-fired gas turbines fueled by a mixture of natural gas and hydrogen gas, or by hydrogen gas alone, has increased with the aim of achieving a hydrogen-based society. Hydrogen gas has a higher combustion rate than natural gas. Therefore, hydrogen-fired gas turbines are more prone to backfires than gas turbines that consume natural gas as a fuel gas. As the concentration of hydrogen gas in the fuel gas is increased, the conditions under which backfires do not occur become narrower, making it difficult to completely suppress backfires during actual operation.

To suppress backfires, a combustion apparatus with a large number of burners, called a cluster burner, inside the combustion apparatus has been studied. However, as the hydrogen gas concentration of the fuel increases, it becomes difficult to completely suppress the actual occurrence of backfires despite the use of a cluster burner.

Patent Literature (PTL) 1 describes a combustor including a control apparatus and a plurality of temperature detectors that detect the temperature in a plurality of combustion zones. The plurality of temperature detectors includes at least one of a thermocouple and an optical pyrometer. The control apparatus is programmed to determine the occurrence of a backfire condition within the plurality of combustion zones based on signals from the temperature detectors and to modify the amount of fuel supplied to the premixing apparatus when the backfire condition occurs.

CITATION LIST

Patent Literature

PTL 1: JP 2010-286232 A

SUMMARY

A detection apparatus according to several embodiments is a detection apparatus for detecting a backfire in a combustion chamber that burns fuel supplied from a plurality of supply ports, the detection apparatus including:

a light source configured to output incident light to an optical fiber laid around the plurality of supply ports;

a converter configured to receive returned light from the optical fiber and convert the received returned light into an electric signal;

a calculator configured to analyze the returned light converted into an electric signal and calculate a temperature at a predetermined position of the optical fiber; and a detector configured to detect a backfire in the combustion chamber based on the calculated temperature.

A combustion system according to several embodiments includes a combustion chamber configured to burn fuel supplied from a plurality of supply ports; and a detection apparatus configured to detect a backfire in the combustion chamber, wherein the detection apparatus includes a light source configured to output incident light to an optical fiber laid around the plurality of supply ports;

a converter configured to receive returned light from the optical fiber and convert the received returned light into an electric signal;

a calculator configured to analyze the returned light converted into an electric signal and calculate a temperature at a predetermined position of the optical fiber; and a detector configured to detect a backfire in the combustion chamber based on the calculated temperature.

DETAILED DESCRIPTION

Figure 1:
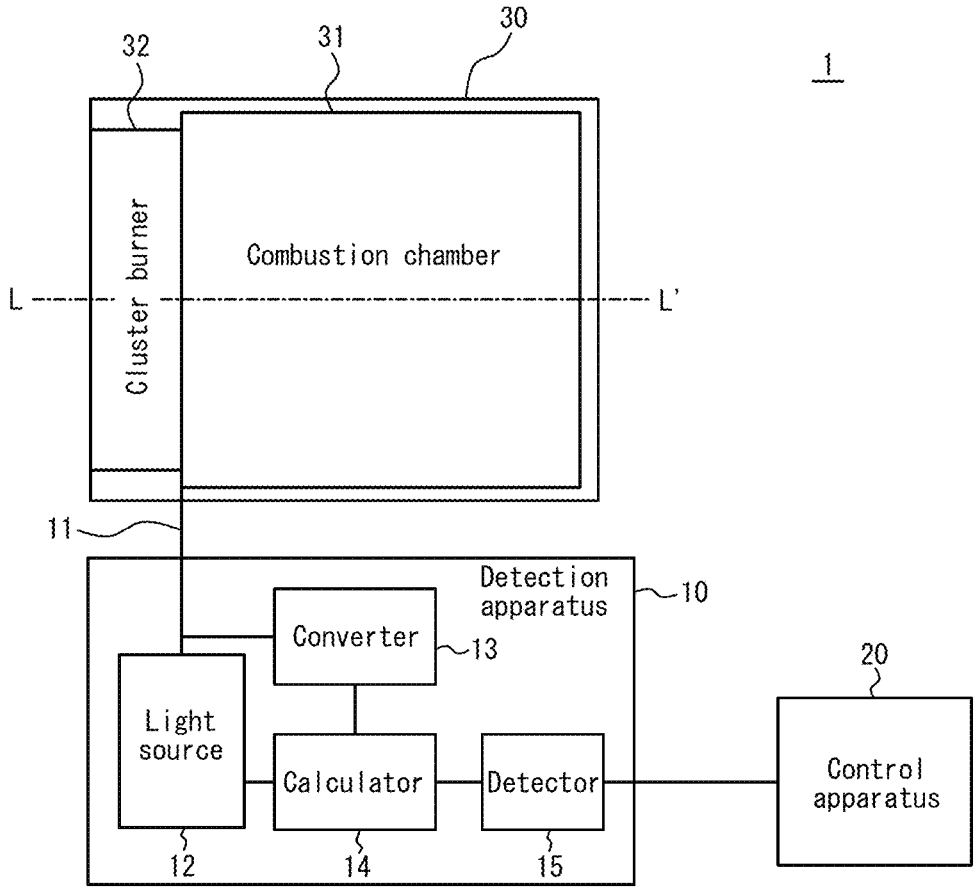
FIG. 1 is a diagram illustrating an example configuration of a combustion system according to an embodiment.

In a case in which a large number of fuel supply ports are present in a combustion apparatus, as in a cluster burner, it is necessary to detect the temperature of each supply port. However, since space is limited in the combustion apparatus, it is difficult to install temperature detectors in a conventional configuration. In addition, in a conventional configuration, the temperature detectors regularly require extensive maintenance, such as replacement, due to degradation in the detection accuracy of the temperature detectors. A conventional configuration thus has room for improvement in terms of appropriately detecting backfires in a combustion apparatus with a large number of fuel supply ports.

It would be helpful to more appropriately detect backfires in a combustion apparatus that includes a large number of fuel supply ports.

A detection apparatus according to several embodiments is (1) a detection apparatus for detecting a backfire in a combustion chamber that burns fuel supplied from a plurality of supply ports, the detection apparatus including:

a light source configured to output incident light to an optical fiber laid around the plurality of supply ports;

a converter configured to receive returned light from the optical fiber and convert the received returned light into an electric signal;

a calculator configured to analyze the returned light converted into an electric signal and calculate a temperature at a predetermined position of the optical fiber; and a detector configured to detect a backfire in the combustion chamber based on the calculated temperature.

The detection apparatus thus detects a backfire by calculating the temperature at a predetermined position of the optical fiber based on the returned light from the optical fiber laid around the plurality of supply ports. Therefore, even in a combustion chamber with a large number of fuel supply ports, such as a cluster burner, a backfire at each supply port can be detected over a long period of time by arranging an optical fiber in a limited space, without the need to install a large number of sensors.

In an embodiment, (2) in the detection apparatus of (1), the calculator may be configured to analyze the returned light and calculate a temperature at a predetermined plurality of positions of the optical fiber as the temperature at the predetermined position.

The detection apparatus thus detects a backfire by calculating the temperature at a predetermined plurality of positions of the optical fiber. It is therefore possible to detect the occurrence of a backfire with high accuracy by measuring the temperature at positions where a backfire may occur, such as near the fuel supply ports.

In an embodiment, (3) in the detection apparatus of (1), the calculator may be configured to analyze the returned light continuously measured over a certain time range and identify a position at which a temperature rise of a certain degree or greater is observed in the optical fiber, and calculate the temperature at the identified position of the optical fiber as the temperature at the predetermined position.

The detection apparatus thus detects a backfire by measuring the temperature at any position of the optical fiber through analysis of the continuously measured returned light over a certain time range. It is therefore possible to detect a backfire based on the temperature at any position on the optical fiber.

In an embodiment, (4) in the detection apparatus of any one of (1) to (3), the calculator may be configured to identify a position in the optical fiber based on a difference between a timing at which the incident light is outputted from the light source and a timing at which the returned light based on the incident light is received, and calculate the temperature at the identified position.

The detection apparatus thus identifies the position of the optical fiber based on the timing of emission of the incident light and the timing of reception of the returned light and can thereby detect a backfire by measuring the temperature at any position in the optical fiber.

In an embodiment, (5) the detection apparatus of any one of (1) to (4) may further include the optical fiber laid around the plurality of supply ports, and the optical fiber may be provided at a supply surface for the fuel in the combustion chamber, the plurality of supply ports being provided on the supply surface.

Since the optical fiber is thus provided at the supply surface for the fuel, a backfire can be properly detected with a simple structure even in a combustion chamber with a large number of fuel supply ports, such as a cluster burner.

In an embodiment, (6) the detection apparatus of any one of (1) to (4) may further include the optical fiber laid around the plurality of supply ports, and the optical fiber may be laid around the plurality of supply ports by an adhesive that is resistant to a temperature higher than a combustion temperature in the combustion chamber.

As a result of the optical fiber thus being provided using an adhesive that is resistant to a temperature higher than the combustion temperature, the optical fiber can be fixed in a combustion chamber that is heated to high temperatures.

In an embodiment, (7) the detection apparatus of any one of (1) to (4) may further include the optical fiber laid around the plurality of supply ports, and the optical fiber may be laid around the plurality of supply ports through a guide formed by welding hollow metal.

As a result of the optical fiber thus being provided through a metal guide, the optical fiber can be fixed in a combustion chamber that is heated to high temperatures.

In an embodiment, (8) the detection apparatus of any one of (1) to (7) may further include a signal output interface configured to output, in response to detection of a backfire in the combustion chamber by the detector, a signal indicating occurrence of the backfire to a control apparatus that controls supply of the fuel to the plurality of supply ports.

Since the control apparatus that controls supply of the fuel is thus notified of the occurrence of a backfire in response to detection of the backfire, the control apparatus can perform control, such as suspending the fuel supply, in response to the backfire.

In an embodiment, (9) the detection apparatus of any one of (1) to (8) may further include a notification interface configured to notify a user of occurrence of a backfire in response to detection by the detector of a backfire in the combustion chamber.

The user is thus notified of the occurrence of a backfire in response to detection of the backfire. The user can therefore respond quickly to the backfire and prevent accidents or the like by taking measures such as suspending the fuel supply.

A combustion system according to several embodiments includes

(10) a combustion chamber configured to burn fuel supplied from a plurality of supply ports; and a detection apparatus configured to detect a backfire in the combustion chamber, wherein the detection apparatus includes a light source configured to output incident light to an optical fiber laid around the plurality of supply ports;

a converter configured to receive returned light from the optical fiber and convert the received returned light into an electric signal;

a calculator configured to analyze the returned light converted into an electric signal and calculate a temperature at a predetermined position of the optical fiber; and a detector configured to detect a backfire in the combustion chamber based on the calculated temperature.

The combustion system thus detects a backfire by calculating the temperature at a predetermined position of the optical fiber based on the returned light from the optical fiber laid around the plurality of supply ports. Therefore, even in a combustion chamber with a large number of fuel supply ports, such as a cluster burner, a backfire at each supply port can be detected over a long period of time by arranging an optical fiber in a limited space, without the need to install a large number of sensors.

In an embodiment,

(11) in the combustion system of (10), supply of the fuel to the supply ports may be controlled in response to detection of a backfire by the detection apparatus.

The combustion system thus controls the fuel supply in response to backfire detection and can thereby prevent accidents caused by backfires.

According to an embodiment of the present disclosure, backfires can more appropriately be detected in a combustion apparatus that includes a large number of fuel supply ports.

Comparative Example

A combustion apparatus according to a comparative example that includes a cluster burner detects the occurrence of a backfire by measuring the temperature near each burner with temperature detectors and controls the supply of fuel and air. In a case in which the temperature detectors are configured by thermocouples, the same number of thermocouples and corresponding wiring as the number of burners is required, making it difficult to install the thermocouples and wiring in a combustion apparatus with limited space. Therefore, it is extremely difficult to properly detect a backfire with thermocouples in the combustion apparatus, according to the comparative example, provided with a cluster burner.

Another possible backfire detection method is to use an optical sensor or pressure sensor as a temperature detector. However, the sensitivity of these sensors deteriorates if the sensors become dirty, including through adhesion of molten metal in the combustion apparatus. In other words, optical sensors become unable to transmit light through the light-receiving surface with age and use. The sensitivity to pressure in a pressure sensor changes upon the pressure-receiving portion becoming dirty. Consequently, it is difficult for a combustion apparatus according to the comparative example that detects backfires using an optical sensor or a pressure sensor to continue to detect backfires over an extended period of time without extensive maintenance.

The configuration according to the comparative example thus has room for improvement in terms of appropriately detecting backfires in a combustion apparatus with a large number of fuel supply ports. In the context of a combustion apparatus with a cluster burner, it is an aim of the present disclosure to enable installation inside the limited space within the combustion apparatus and enable continued detection of backfires over an extended period of time without extensive maintenance.

Embodiment

An embodiment of the present disclosure is now described with reference to the drawings. Portions having an identical configuration or function in the drawings are labeled with the same reference signs. In the explanation of the present embodiment, a redundant description of identical portions may be omitted or simplified as appropriate.

FIG. 1 is a diagram illustrating an example configuration of a combustion system 1 according to an embodiment. The combustion system 1 includes a detection apparatus 10, a control apparatus 20, and a combustion apparatus 30. The combustion apparatus 30 combusts a mixed gas that includes air and fuel gas. The control apparatus 20 controls the operation of the combustion apparatus 30 with respect to matters such as the supply of air and mixed gas. The detection apparatus 10 detects backfires in the combustion apparatus 30. A backfire is a flame, in a combustion chamber 31, that travels in a fuel nozzle 323 of a burner 321 in the direction from the combustion chamber 31 toward the interior of the burner 321 (see FIG. 3).

The combustion apparatus 30 includes a combustion chamber 31 and a cluster burner 32. The cluster burner 32 includes a plurality of fuel supply ports (burners 321) and supplies a mixed gas including air and fuel gas to the combustion chamber 31. The combustion chamber 31 has a space in which the mixed gas supplied from the cluster burner 32 is burned. In the present embodiment, the fuel is hydrogen gas, but this configuration is not limiting. For example, the fuel may be a mixed gas including hydrogen gas and natural gas, the fuel may be natural gas, or the fuel may be any fluid usable as fuel.

The detection apparatus 10 includes an optical fiber 11, a light source 12, a converter 13, a calculator 14, and a detector 15.

The optical fiber 11 propagates the incident light outputted from the light source 12 and the returned light with respect to the incident light. The optical fiber 11 is configured by a transparent dielectric such as quartz glass or plastic. In the present embodiment, the detection apparatus 10 includes one optical fiber 11, but the number of optical fibers 11 may be two or more.

The light source 12 outputs incident light into the optical fiber 11. The light source 12 may, for example, be configured by a laser that generates coherent light.

The converter 13 converts the returned light from the optical fiber 11 into an electric signal. The converter 13 may, for example, be configured by a photodiode using a pn junction.

The calculator 14 analyzes the electric signal of the returned light to calculate the temperature at any position on the optical fiber 11. In the optical fiber 11, scattering of light such as Brillouin scattering or Raman scattering occurs. The frequency shift of scattered light due to Brillouin scattering depends on the temperature of the optical fiber 11 in the region of the optical fiber 11 where the scattering occurs. The power of the scattered light due to Raman scattering depends on the temperature of the optical fiber 11 in the region of the optical fiber 11 where the scattering occurs. The calculator 14 may therefore calculate the temperature around the optical fiber 11 based on the frequency shift or the optical power of the returned light. The time from when the detection apparatus 10 emits the incident light until the detection apparatus 10 receives the returned light differs depending on the distance from the light source 12. Based on this time, the calculator 14 identifies the position in the optical fiber 11 of the point where the temperature is being measured.

In the present embodiment, the calculator 14 calculates the temperature using, for example, the returned light due to Brillouin scattered light or Raman scattered light in the optical fiber 11 as the returned light for calculating the temperature, but returned light based on something else may also be used. However, transmission loss of the optical fiber 11 increases in high temperature regions such as the region around the flame in the combustion chamber 31. Therefore, in the case of Raman scattered light, the conversion coefficient for converting optical power to temperature changes, which degrades the accuracy of temperature measurement. In contrast, since the frequency shift is not affected by transmission loss in the case of Brillouin scattered light, the conversion coefficient for converting the frequency shift to temperature is unchanged, and the accuracy of temperature measurement does not degrade. The temperature index is thus less likely to change in the case of using Brillouin scattered light as compared to using Raman scattered light. The calculator 14 may therefore calculate the temperature using Brillouin scattered light as the returned light.

The detector 15 detects a backfire based on the result of calculating the temperature in the calculator 14. Specifically, in a case in which the temperature at any position of the optical fiber 11 exceeds a predetermined threshold, for example, the detector 15 may detect the occurrence of a backfire at the supply port near the position. The detector 15 may function as a signal output interface that outputs, in response to the detection of a backfire in the combustion chamber 31, a signal indicating the occurrence of the backfire to the control apparatus 20 that controls the supply of fuel to the plurality of burners 321.

In the above configuration, the combustion system 1 includes an optical fiber 11 laid around a plurality of supply ports of the cluster burner 32 and detects backfires by analyzing the returned light with respect to the incident light incident on the optical fiber 11 and calculating the temperature at any position of the optical fiber 11. Therefore, according to the combustion system 1, backfires can be properly detected in the combustion chamber 31 of the cluster burner 32, where space is limited, over an extended period of time without extensive maintenance.

Figure 2:
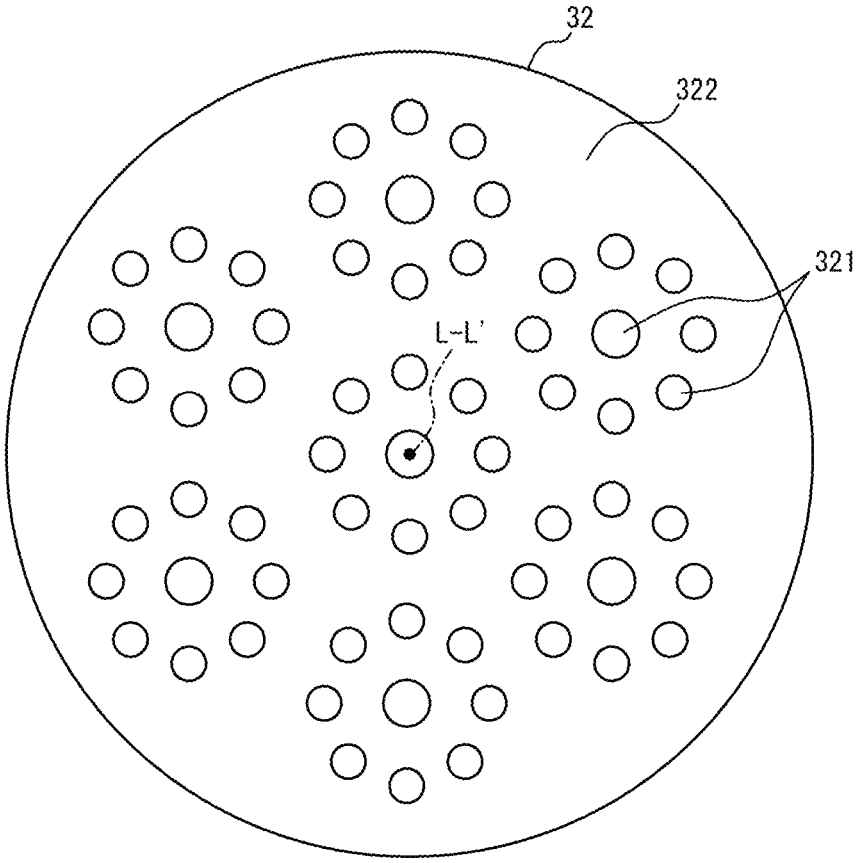
FIG. 2 is a diagram illustrating an example of a plate included in the cluster burner in FIG. 1.

FIG. 2 is a diagram illustrating an example of a plate 322 included in the cluster burner 32 in FIG. 1. The cluster burner 32 includes the plate 322, and the plate 322 has a large number of burners 321 on an output surface of fuel to the combustion chamber 31. Each burner 321 forms a fuel supply port. In the examples in FIGS. 1 and 2, the cluster burner 32 has the shape of a cylinder centered on an axis L-L', but the cluster burner 32 may have any shape.

Figure 3:
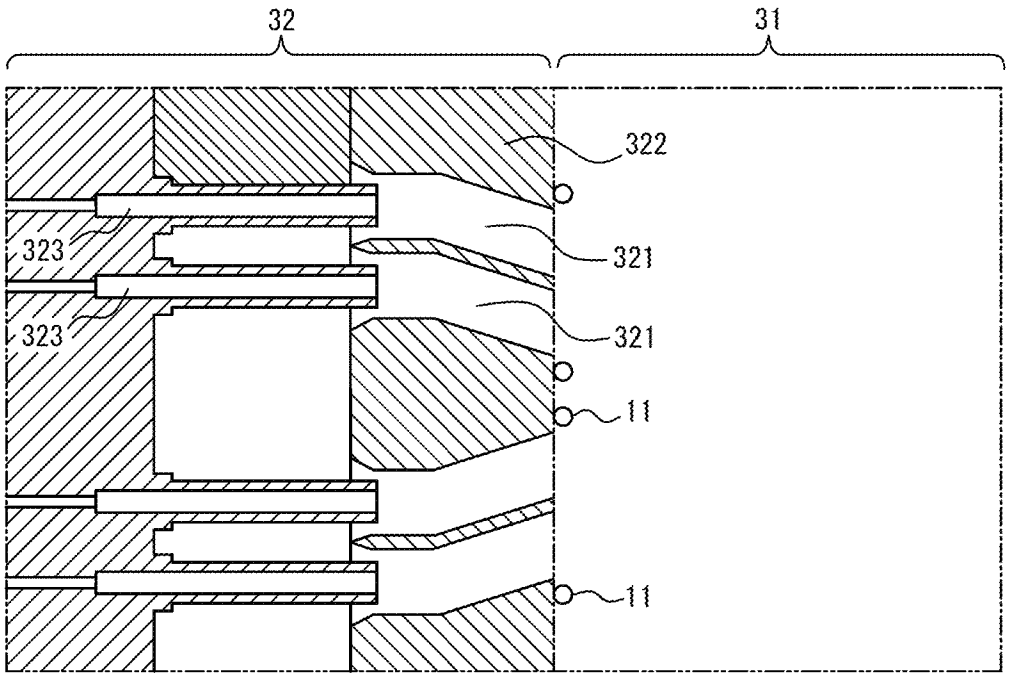
FIG. 3 is a cross-sectional diagram illustrating an example of the boundary between the cluster burner and the combustion chamber in FIG. 1.

FIG. 3 is a cross-sectional diagram illustrating an example of the boundary between the cluster burner 32 and the combustion chamber 31 in FIG. 1. FIG. 3 illustrates an enlargement of a portion of the boundary between the cluster burner 32 and the combustion chamber 31. As illustrated in FIG. 3, the interior of the burners 321 provided on the plate 322 is hollow. Each burner 321 connects to a fuel nozzle 323 for supplying fuel. The fuel supplied from the fuel nozzle 323 is supplied from the burner 321 into the combustion chamber 31 and is burned.

Figure 4:
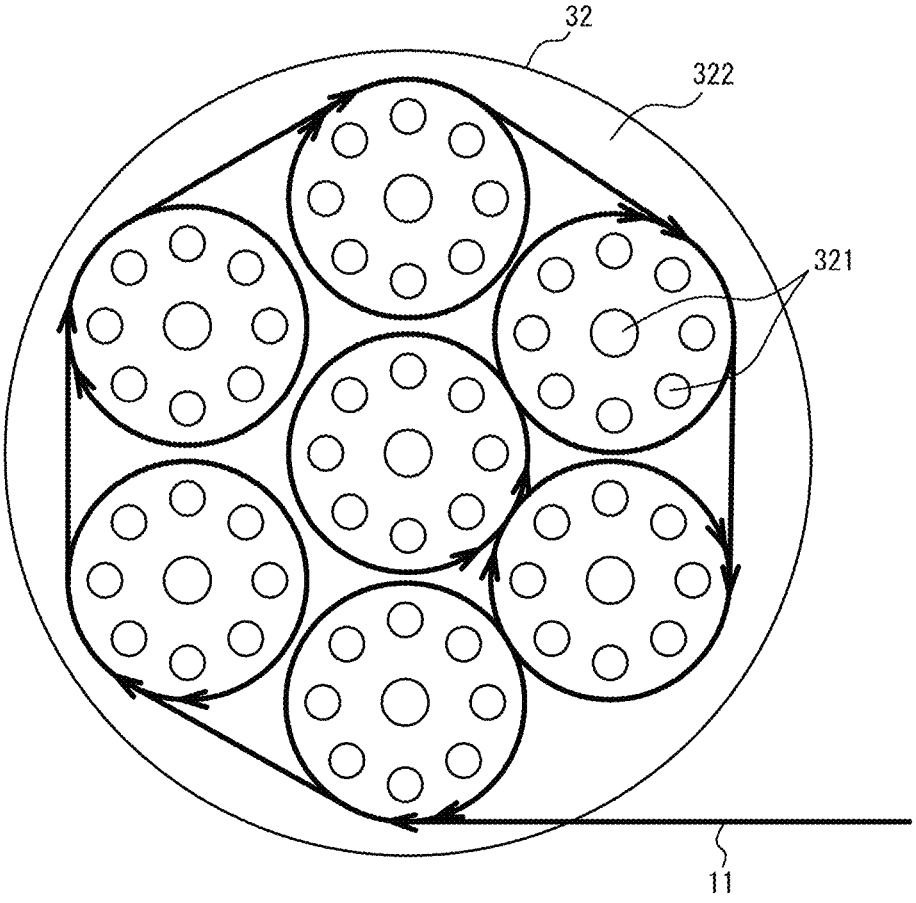
FIG. 4 is a diagram illustrating an example of a plate provided with an optical fiber.

FIG. 4 is a diagram illustrating an example of the plate 322 provided with the optical fiber 11. As illustrated in FIGS. 3 and 4, the optical fiber 11 is laid on the plate 322, on which the plurality of burners 321 is provided, so as to pass around some or all of the burners 321.

In FIG. 4, the optical fiber 11 is provided to surround the plurality of burners 321 in a circular pattern, but the path of the optical fiber 11 is not limited to this example. The temperature around the burners 321 is high. The optical fiber 11 may therefore be adhered to the output surface (plate 322) of the plurality of burners 321, which form the cluster burner 32, with a ceramic adhesive that has a high heat resistance temperature. Alternatively, the optical fiber 11 may be installed through a guide formed by welding hollow metal onto the plate 322. Furthermore, the optical fiber 11 may be coated with a metal coating, such as gold, to improve heat resistance.

The control apparatus 20 performs appropriate control to prevent or minimize damage to all gas turbine equipment, including the combustion apparatus 30, based on the result of backfire detection communicated from the detection apparatus 10. The control apparatus 20 may, for example, be provided as a fuel supply apparatus that supplies fuel to the burners 321 forming the cluster burner 32. In this case, the control apparatus 20 performs adjustment by measures such as reducing the supply of fuel to the burner 321 or suspending the supply of fuel once the detection apparatus 10 communicates that a backfire has been detected. However, this configuration is not limiting. The control apparatus 20 may, for example, be an apparatus that notifies the user of an alarm by audio, light, or the like in response to detection of a backfire. Such a control apparatus 20 may be provided as part of the configuration of the detection apparatus 10. In other words, the detection apparatus 10 may further include a notification interface that notifies the user of the occurrence of a backfire by sound, light, or the like in response to detection by the detector 15 of a backfire in the combustion chamber 31.

In the above configuration, the detection apparatus 10 measures temperature and detects backfires as follows. The light source 12 causes light to be incident on the optical fiber 11. The converter 13 converts the returned light from the optical fiber 11 into an electric signal. The calculator 14 calculates the temperature at a predetermined position of the optical fiber 11 (for example, a position around the burner 321) from the electric signal and may treat the result as the temperature measurement by the detection apparatus 10. The detector 15 may compare the calculated value of the temperature at the predetermined position with a predetermined temperature threshold and determine that a backfire has occurred in a case in which the calculated value of the temperature is greater than the threshold. Upon detecting a backfire, the detection apparatus 10 communicates to the control apparatus 20 that a backfire has been detected in the burner 321 near the predetermined position. The control apparatus 20 performs appropriate control to prevent or minimize damage to all gas turbine equipment, including the combustion apparatus 30, based on the result communicated from the detector 15 of the detection apparatus 10.

As described above, the combustion system 1 includes the detection apparatus 10 for detecting a backfire in the combustion chamber 31 that burns fuel supplied from a plurality of supply ports (burners 321). The detection apparatus 10 includes the optical fiber 11, the light source 12, the converter 13, the calculator 14, and the detector 15. The light source 12 outputs incident light into the optical fiber 11 laid around the plurality of supply ports. The converter 13 receives the returned light from the optical fiber 11 with respect to the incident light and converts the received returned light into an electric signal. The calculator 14 analyzes the returned light converted into an electric signal to calculate the temperature at a predetermined position of the optical fiber 11. The detector 15 detects a backfire in the combustion chamber 31 based on the calculated temperature.

The detection apparatus 10 can therefore detect backfires in a plurality of burners 321 with one optical fiber 11, greatly reducing the number of sensors and wires for detecting temperature. Even in a combustion apparatus 30 that includes a cluster burner 32, this makes it possible to install a temperature sensor within the limited space in the combustion apparatus 30 and detect backfires. Furthermore, the detection apparatus 10 included in the combustion system 1 measures the temperature of the optical fiber 11 itself and detects a backfire based on the measurement result. Therefore, even if dirt adheres to the surface of the optical fiber 11, the performance of temperature measurement is not affected, and the detection apparatus 10 can continue to detect backfires without extensive maintenance. Use of the detection apparatus 10 and the combustion system 1 according to the present embodiment thus enables continued detection of backfires over an extended period of time without extensive maintenance, even if the cluster burner 32 is included.

The detection apparatus 10 may analyze the returned light and calculate the temperature at a predetermined plurality of positions of the optical fiber 11 as the temperature at the predetermined position and detect a backfire based on the temperature. For example, the detection apparatus 10 may calculate the temperature at positions of the optical fiber 11 provided near the burners 321 as the temperature at the predetermined position. It is therefore possible to detect the occurrence of a backfire with high accuracy by measuring the temperature at positions where a backfire may occur, such as near the fuel supply ports (burners 321).

The detection apparatus 10 may analyze the returned light continuously measured over a certain time range and identify a position at which a temperature rise of a certain degree or greater is observed in the optical fiber 11. The detection apparatus 10 may calculate the temperature at the identified position of the optical fiber 11 as the temperature at the predetermined position. The detection apparatus 10 thus detects a backfire by measuring the temperature at any position of the optical fiber 11, rather than at a predetermined position, through analysis of the continuously measured returned light over a certain time range. The detection apparatus 10 can therefore detect a temperature rise at a position that is difficult to predict in advance, enabling a more appropriate response to problems such as backfires.

In such mapping of the position in the optical fiber 11 to the temperature, the calculator 14 of the detection apparatus 10 may identify a position in the optical fiber 11 based on the difference between the timing at which the incident light is outputted from the light source 12 and the timing at which the returned light based on the incident light is received, and may calculate the temperature at the identified position. The detection apparatus 10 can therefore measure the temperature at any position in the optical fiber 11 to detect a backfire.

The detection apparatus 10 may include the optical fiber 11 laid around the plurality of burners 321. The optical fiber 11 may be provided at a supply surface for the fuel in the combustion chamber 31, the plurality of burners 321 being provided on the supply surface. The detection apparatus 10 can therefore properly detect a backfire with a simple structure even in a combustion apparatus 30 with a large number of fuel supply ports, such as the cluster burner 32.

The optical fiber 11 may be laid around the plurality of burners 321 by an adhesive that is resistant to a temperature higher than the combustion temperature in the combustion chamber 31. For example, the optical fiber 11 may be adhered to the plate 322 by a ceramic adhesive. Alternatively, the optical fiber 11 may be laid around the plurality of burners 321 through a guide formed by welding hollow metal. This configuration enables the optical fiber 11 to be secured even in a combustion chamber 31 that reaches extremely high temperatures.

The detection apparatus 10 may output, in response to the detection by the detector 15 of a backfire in the combustion chamber 31, a signal indicating the occurrence of the backfire to the control apparatus 20 that controls the supply of fuel to the plurality of burners 321. Since the detection apparatus 10 thus notifies the control apparatus 20 that controls supply of the fuel of the occurrence of a backfire in response to detection of the backfire, the control apparatus 20 can perform control, such as suspending the fuel supply, in response to the backfire.

The combustion system 1 includes the detection apparatus 10, such as the one described above, and the combustion chamber 31 that burns fuel supplied from the plurality of burners 321. The combustion system 1 controls the supply of fuel to the burners 321 in response to the detection of a backfire by the detection apparatus 10. The combustion system 1 can therefore prevent accidents caused by backfires.

The present disclosure is not limited to the above embodiments. For example, a plurality of blocks described in the block diagrams may be integrated, or a block may be divided. Other modifications can be made without departing from the spirit of the present disclosure.

The invention claimed is:

1. A detection apparatus for detecting a backfire in a combustion chamber that burns fuel supplied from a plurality of supply ports, the detection apparatus comprising:

an optical fiber laid around the plurality of supply ports;

a light source configured by a laser which outputs incident light to the optical fiber;

a converter configured by a photodiode which receives returned light from the optical fiber and converts the received returned light into an electric signal; and at least one physical processor, wherein the at least one physical processor analyzes the returned light converted into the electric signal and calculates a temperature at a predetermined position of the optical fiber; and the at least one physical processor detects a backfire in the combustion chamber based on the calculated temperature, wherein the optical fiber is disposed on a side of a supply surface plate for the fuel in the combustion chamber, the side of the supply surface plate facing a space where combustion occurs, the plurality of supply ports being provided on the supply surface plate, and the optical fiber being laid so as to surround some or all of the plurality of supply ports.

2. The detection apparatus according to claim 1, wherein the at least one physical processor is configured to analyze the returned light and calculate a temperature at a predetermined plurality of positions of the optical fiber as the temperature at the predetermined position.

3. The detection apparatus according to claim 1, wherein the at least one physical processor is configured to analyze the returned light continuously measured over a certain time range and identify a position at which a temperature rise of a certain degree or greater is observed in the optical fiber, and calculate the temperature at the identified position of the optical fiber as the temperature at the predetermined position.

4. The detection apparatus according to claim 1, wherein the at least one physical processor is configured to identify a position in the optical fiber based on a difference between a timing at which the incident light is outputted from the light source and a timing at which the returned light based on the incident light is received, and calculate the temperature at the identified position.

5. The detection apparatus according to claim 1, wherein the optical fiber is laid around the plurality of supply ports by an adhesive that is resistant to a temperature higher than a combustion temperature in the combustion chamber.

6. The detection apparatus according to claim 1, wherein the optical fiber is laid around the plurality of supply ports through a guide formed by welding hollow metal.

7. The detection apparatus according to claim 1, further comprising a signal output interface configured to output, in response to detection of a backfire in the combustion chamber, a signal indicating occurrence of the backfire to a control apparatus that controls supply of the fuel to the plurality of supply ports.

8. The detection apparatus according to claim 1, further comprising a notification interface configured to notify a user of occurrence of a backfire in response to detection of a backfire in the combustion chamber.

9. A combustion system comprising:

a combustion chamber configured to burn fuel supplied from a plurality of supply ports; and a detection apparatus configured to detect a backfire in the combustion chamber, wherein the detection apparatus comprises:

an optical fiber laid around the plurality of supply ports;

a light source configured by a laser which outputs incident light to the optical fiber;

a converter configured by a photodiode which receives returned light from the optical fiber and converts the received returned light into an electric signal; and at least one physical processor, wherein the at least one physical processor analyzes the returned light converted into the electric signal and calculates a temperature at a predetermined position of the optical fiber; and the at least one physical processor detects a backfire in the combustion chamber based on the calculated temperature, wherein the optical fiber is disposed on a side of a supply surface plate for the fuel in the combustion chamber, the side of the supply surface plate facing a space where combustion occurs, the plurality of supply ports being provided on the supply surface plate, and the optical fiber being laid so as to surround some or all of the plurality of supply ports.

10. The combustion system according to claim 9, wherein supply of the fuel to the supply ports is controlled in response to detection of a backfire by the detection apparatus.

* * * * *